US008138401B2

(12) United States Patent
Fujiwara et al.

(10) Patent No.: US 8,138,401 B2
(45) Date of Patent: Mar. 20, 2012

(54) ELECTRONIC ASSISTANT SYSTEM FOR LESSON IN MUSIC AND MUSICAL INSTRUMENT EQUIPPED WITH THE SAME

(75) Inventors: Yuji Fujiwara, Hamamatsu (JP); Tsutomu Sasaki, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 520 days.

(21) Appl. No.: 12/168,761

(22) Filed: Jul. 7, 2008

(65) Prior Publication Data

US 2009/0013856 A1 Jan. 15, 2009

(30) Foreign Application Priority Data

Jul. 13, 2007 (JP) ..... 2007-184851

(51) Int. Cl.
*G10F 1/02* (2006.01)

(52) U.S. Cl. ..... 84/20

(58) Field of Classification Search ..... 84/13–25
See application file for complete search history.

(56) References Cited

U.S. PATENT DOCUMENTS

| | | | |
|---|---|---|---|
| 4,593,592 | A | 6/1986 | Stahnke |
| 6,359,207 | B1 | 3/2002 | Oba et al. |
| 2002/0184989 | A1 | 12/2002 | Meisel |
| 2005/0204906 | A1 | 9/2005 | Lengeling |
| 2006/0130640 | A1 | 6/2006 | Fujiwara |
| 2006/0185503 | A1 | 8/2006 | Fujiwara |

FOREIGN PATENT DOCUMENTS

| | | | |
|---|---|---|---|
| CN | 1677484 | A | 10/2005 |
| CN | 1825426 | A | 8/2006 |
| DE | 2741355 | | 3/1979 |
| EP | 1837855 | | 9/2007 |
| EP | 1840869 | | 10/2007 |
| EP | 1881479 | | 1/2008 |
| EP | 1895503 | | 3/2008 |
| JP | 2006-178197 | | 7/2006 |
| JP | 2006-178197 | | 7/2006 |
| JP | 2006-243639 | | 9/2006 |

*Primary Examiner* — Elvin G Enad
*Assistant Examiner* — Andrew R Millikin
(74) *Attorney, Agent, or Firm* — Harness, Dickey & Pierce, PLC

(57) ABSTRACT

While a player is fingering a music tune on a piano, an electronic assistant system monitors the keys to see whether or not the player starts to produce tones through a particular playing technique such as repetition; when the electronic assistant system finds particular key movements unique to the particular playing technique in an early stage, the electronic assistant system decides that the player intends to produce the tone through the particular playing technique, and forces the key to travel on a reference key trajectory in the later stage, whereby the player learns the particular playing technique.

18 Claims, 9 Drawing Sheets

ELECTRONIC ASSISTANT SYSTEM FOR LESSON IN MUSIC AND MUSICAL INSTRUMENT EQUIPPED WITH THE SAME

FIELD OF THE INVENTION

This invention relates to an electronic assistant system for a lesson in music and a musical instrument equipped with the electronic assistant system.

DESCRIPTION OF THE RELATED ART

There is known an automatic player musical instrument. The automatic player musical instrument is a combination between an acoustic musical instrument and an automatic playing system. A player can play a music tune on the automatic player musical instrument as similar to performance of the music tune on the acoustic musical instrument. When users wish to enjoy themselves in performance of a music tune without any fingering of a human player, the user instructs the automatic playing system to reproduce the music tune. Then, the acoustic musical instrument is driven for the performance of the music tune by means of the automatic playing system. Thus, the automatic playing system serves as an automatic player instead of the human player.

The automatic playing system is further available for lessons in music. An automatic playing system is assumed to be combined with an acoustic piano. System components of the automatic playing system form an electronic assistant system, and the electronic assistant system guides a trainee in fingering on the acoustic piano. The electronic assistant system sequentially reads out music data codes expressing the note events from a music data file, and specifies black keys and white keys to be depressed by the trainee. The electronic assistant system makes the black keys and white keys shallowly sunk before the trainee depresses them. Thus, the prior art electronic assistant system preliminarily notifies the trainee of the black keys and white keys to be depressed in his or her performance.

Another prior art electronic assistant system is disclosed in Japan Patent Application laid-open No. 2006-178197. The prior art electronic assistant system disclosed in the laid-open visually assists a trainee in fingering. While a music teacher is giving an exhibition performance on an array of keys, which are referred to as "master keys", the controller determines the loci of depressed master keys, and gives rise to movements of keys, which are referred to as "slave keys", on predetermined trajectories identical with those of the master keys. Thus, the prior art electronic assistant system visualizes the movements of master keys through the slave keys.

While the prior art electronic assistant system is reproducing the movements of keys, the controller forces the slave keys to travel on the predetermined trajectories through a servo control loop. There are various servo control techniques as disclosed in Japan Patent Application laid-open No. 2006-243639. One of the prior art servo control techniques makes the loci of keys closer to the predetermined trajectories than the loci in another servo control technique, and another prior art servo control technique makes the movements of keys more stable than those reproduced through the prior art servo control technique. The prior art automatic playing system disclosed in Japan Patent Application laid-open No. 2006-243639 makes it possible to select one of the servo control techniques by users.

There are various playing techniques used in performance of a musical instrument. While a player is playing a note in tremole, two tones are alternately rapidly produced through the musical instrument. A human player may wish softly to prolong a tone immediately after playing the tone in forte. This playing technique is hereinafter referred to as "forte-piano". Professional pianists may feel performance on music tunes in these high-degree playing techniques not difficult. However, it is not easy for beginners to lean the high-degree playing techniques.

SUMMARY OF THE INVENTION

It is therefore an important object of the present invention to provide an electronic assistant system, which makes trainees learn particular playing techniques on a musical instrument.

It is also an important object of the present invention to provide a musical instrument, in which the electronic assistant system is installed.

To accomplish the object, the present invention proposes to exhibit a particular playing technique when a player intends to produce music sound through the particular playing technique.

In accordance with one aspect of the present invention, there is provided an electronic assistant system for a player comprising a sensor system monitoring manipulators of a musical instrument and producing detecting signals representative of pieces of performance data expressing movements of the manipulators, actuators provided in association with the manipulators and responsive to a driving signal so as to move the manipulators, an analyzer connected to the sensor system and analyzing the pieces of performance data to see whether or not at least one of the manipulators takes a particular movement indicative of player's intention to produce music sound through a particular playing technique, and a driver connected to the actuators and the analyzer and supplying the driving signal to associated one of the actuators so as to give rise to a movement of the aforesaid one of the manipulators featuring the particular playing technique when the analyzer gives the answer affirmative.

In accordance with another aspect of the present invention, there is provided a musical instrument, on which a player performs pieces of music, comprising manipulators manipulated by the player for the pieces of music, a tone generator connected to the manipulators and responsive to the manipulation on the manipulators so as to produce music sound for the pieces of music, an electronic assistant system provided in association with the manipulators and including a sensor system monitoring the manipulators and producing detecting signals representative of pieces of performance data expressing movements of the manipulators, actuators provided in association with the manipulators and responsive to a driving signal so as to move the manipulators, an analyzer connected to the sensor system and analyzing the pieces of performance data to see whether or not at least one of the manipulators takes a particular movement indicative of player's intention to produce the music sound through a particular playing technique and a driver connected to the actuators and the analyzer and supplying the driving signal to associated one of the actuators so as to give rise to a movement of the aforesaid one of the manipulators featuring the particular playing technique when the analyzer gives the answer affirmative.

BRIEF DESCRIPTION OF THE DRAWINGS

The features and advantages of the electronic assistant system and musical instrument will be more clearly understood from the following description taken in conjunction with the accompanying drawings, in which.

DESCRIPTION OF THE PREFERRED EMBODIMENTS

Figure 1:
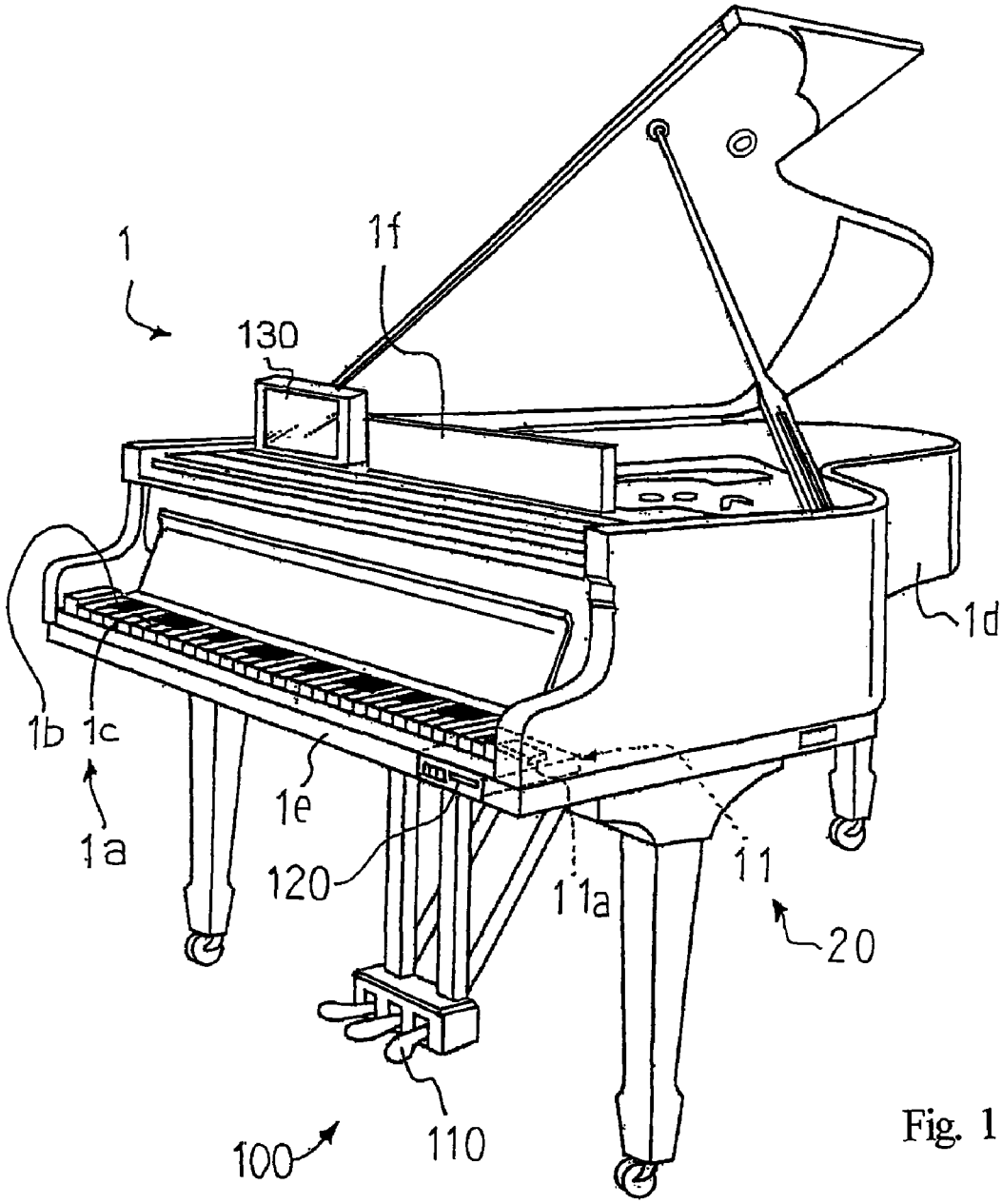
FIG. 1 is a schematic perspective view showing the external appearance of an automatic player piano of the present invention.

A musical instrument embodying the present invention a musical instrument is prepared for a player. The player performs pieces of music through various sorts of playing techniques with the assistance of an electronic assistant system, or practices fingering especially particular high-level playing techniques also with the assistance of the electronic assistant system. The electronic assistant system is built in an acoustic musical instrument or an electronic musical instrument. Otherwise, the electronic assistant system is offered to users separately from the musical instruments.

The musical instrument embodying the present invention comprises manipulators, a tone generator and the electronic assistant system. The manipulators are manipulated by the player for performing pieces of music. The manipulators are connected to the tone generator. The tone generator is responsive to the manipulation on the manipulators so as to produce music sound for the pieces of music.

The electronic assistant system is provided in association with the manipulators, and includes a sensor system, actuators, an analyzer and a driver. These system components are hereinafter described in detail.

The sensor system monitors the manipulators, and produces detecting signals representative of pieces of performance data. The pieces of performance data express movements of the manipulators. The actuators are provided in association with the manipulators, and are responsive to a driving signal so as to move the manipulators. Therefore, the actuators give rise to the movements of manipulators without any fingering of the player.

The analyzer is connected to the sensor system so that the pieces of performance data are supplied to the analyzer. The analyzer analyzes the pieces of performance data to see whether or not at least one of the manipulators takes a particular movement. The particular movement is indicative of player's intention to produce the music sound through the particular playing technique so that the analyzer can discriminate the player's intention immediately before an exhibition for the particular playing technique.

The driver is connected to the actuators and the analyzer. The driver receives the result of analysis from the analyzer, and selectively supplies the driving signal to the actuators. When the analyzer gives the driver affirmative answer as the result of analysis, the driver supplies the driving signal to associated one of the actuator so as to give rise to a movement featuring the particular playing technique for the aforesaid one of the manipulators.

Thus, while the player is fingering pieces of music on the manipulators, the analyzer discriminates player's intension before the exhibition, and the driver gives rise to the movements featuring the particular playing technique for giving the exhibition. Thus, the player can learn how to manipulate the manipulator in the particular playing technique. Moreover, if a player is week in the particular playing technique, he or she can well perform the pieces of music with the assistance of the electronic assistant system.

In the following description, term "front" is indicative of a position closer to a human player, who is sitting on a stool for fingering, than a position modified with term "rear". "Longitudinal direction" passes through a front position and a corresponding rear position, and "lateral direction" crosses the longitudinal direction at right angle. "Up-and-down direction" is normal to a plane defined by the longitudinal direction and lateral direction.

"Depressed key" means a key, the front portion of which is downwardly being sunk from initial state under the condition that external force is exerted thereon, and "released key" is a key, the front portion of which is being recovered to the initial state.

First Embodiment

Figure 2:
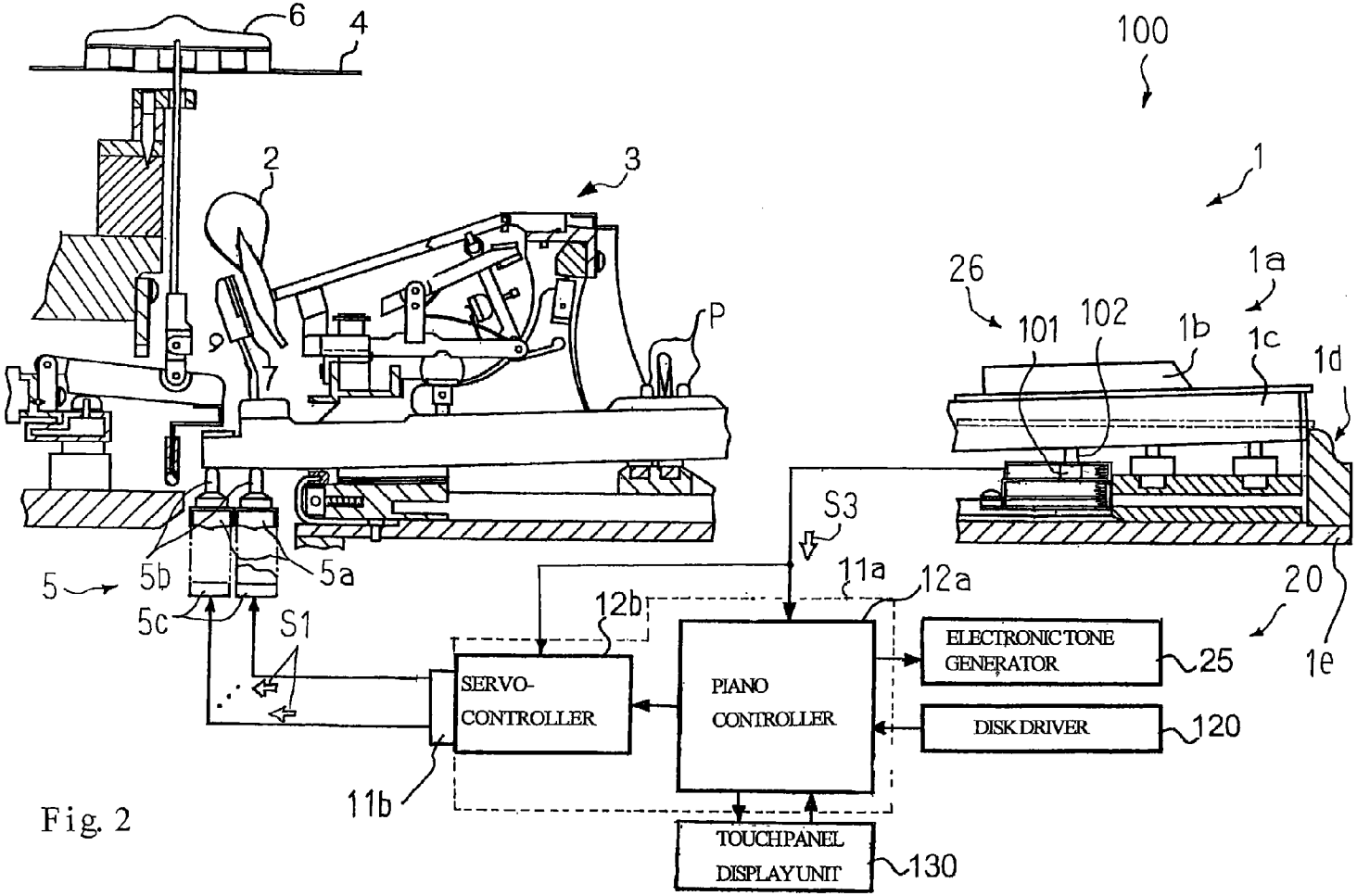
FIG. 2 is a cross sectional side view showing the structure of the automatic player piano.

Referring first to FIGS. 1 and 2 of the drawings, reference numeral 100 designates an automatic player piano embodiment the present invention. The automatic player piano 100 largely comprises an acoustic piano 1 and an electric system 20, and the electric system 20 is installed in the acoustic piano 1. A human player performs music tunes on the acoustic piano 1 as similar to a pianist who performs the music tunes on a standard piano.

The electric system 20 has information processing capability so as to serve as a recording system, an automatic playing system, a playback system and an electronic assistant system through execution of sub-routine programs. In detail, while the sub-routine program for recording is running, the electric system serves as the recording system, and performance on the acoustic piano 1 is recorded through the recording system. While the subroutine program for automatic playing is running, the electric system 20 serves as the automatic playing system, and the automatic playing system performs a music tune on the acoustic piano 1 without any fingering of a human player. The subroutine program for playback makes the electric system 20 reproduce electronic tones on the basis of music data codes. On the other hand, while the sub-routine program for the electronic assistance is running, the electric system 20 serves as the electronic assistant system, and the electronic assistant system exhibits a high-degree playing technique on the acoustic piano 1 so as to make the human player lean the high-degree playing technique through the exhibition. The exhibition is given to the human player through the automatic playing capability, and the automatic playing for the exhibition is hereinafter referred to as "partial automatic playing"

Acoustic Piano

The acoustic piano 1 includes a keyboard 1*a*, i.e., an array of black keys 1*b* and white keys 1*c*, hammers 2, action units 3, strings 4, damper units 6, a pedal mechanism 110 and a piano cabinet 1*d*. The keyboard 1*a* is mounted on a key bed 1*e*, which forms a bottom part of the piano cabinet 1*d*, and the hammers 2, action units 3, strings 4 and damper units 9 are provided inside the piano cabinet 1*d*.

The black keys 1*b* and white keys 1*c* are arrayed in the lateral direction, and are linked with the action units 3 at the intermediate portions thereof and damper units 6 at the rear portions thereof. While force is being exerted on the front portions of keys 1*b* and 1*c*, the black keys 1*b* and white keys 1*c* travel from rest positions to end positions along respective trajectories, and the black keys 1*b* and white keys 1*c* actuate the associated action units 3.

The action units 3 are further linked with the hammers 2, and the hammers are rotatable. For this reason, the movements of keys 1*b* and 1*c* are transmitted through the action units 3 to the hammers 2, and give rise to rotation of hammers 2. The hammers 2 are opposed to the strings 4, and give rise to vibrations of the strings 4 at the end of rotation. A human player and the automatic playing system drive the hammers 2 for the rotation by depressing and releasing the black keys 1*b* and white keys 1*c*. A back check 7 forms a part of the action unit 3, and makes the hammers 2 softly landed thereon.

The depressed black keys 1*b* and depressed white keys 1*c* make the associated damper units 6 spaced from and brought into contact with the strings 4 depending upon the key positions on the trajectories of keys 1*b*/1*c*. While the damper units 6 are held in contact with the strings 4, the strings 4 are prohibited from the vibrations. However, when the damper units 6 are spaced from the strings 4, the strings 4 are permitted to vibrate.

The pedal mechanism 110 is linked with the keyboard 1*a* and damper units 6, and is used for pedal effects on the tones. The pedal effects are well known to human players, and no further description is hereinafter incorporated for the sake of simplicity.

A human player performs a music tune on the acoustic piano 1 as follows. While all of the black and white keys 1*b*/1*c* are staying at the rest positions, the hammers 2 are spaced from the associated strings 4, and the damper units 6 are held in contact with the strings 4 as shown in FIG. 2. When the human player starts his or her performance, he or she selectively depresses the black keys 1*b* and white keys 1*c*, and releases the depressed keys 1*b* and 1*c*. The performance through the fingering of a human player is hereinafter referred to as "a manual playing".

When the human player depresses one of the black and white keys 1*b*/1*c*, the depressed key 1*b*/1*c* starts to travel on the trajectory. While the depressed key 1*b*/1*c* is traveling on the trajectory toward the end position, the depressed key 1*b*/1*c* causes the damper units 6 to be spaced from the associated strings 4, and the damper units 6 permit the strings 6 to vibrate. The depressed key 1*b*/1*c* further actuates the associated action unit 3. The actuated action unit 3 makes the hammer 2 driven for rotation toward the associated string 4. The hammer 2 is brought into collision with the string 4 at the end of rotation, and gives rise to vibrations of the string 4. The vibrating string 4 in turn gives rise to the vibrations of a sound board, which forms a part of the piano cabinet 1*d*, and an acoustic piano tone is radiated from the acoustic piano 1. The hammer 2 rebounds on the string 4, and is softly landed on the back check 7.

The loudness of acoustic piano tone is proportional to the velocity of hammer 2 immediately before the collision with the string 4. The human player strongly depresses the black keys 1*b* and white keys 1*c* so as to produce the acoustic piano tones at large loudness. On the other hand, the human player gently depresses the black keys 1*b* and white keys 1*c* for the acoustic piano tones at small loudness.

When the human player releases the depressed key 1*b*/1*c*, the released key 1*b*/1*c* starts backwardly to travel on the trajectory. The released key 1*b*/1*c* permits the damper unit 6 to move toward the string 4, and is brought into contact with the vibrating string 4 so as to decay the vibrations. The released key 1*b*/1*c* further permits the action unit 3 to return to the rest position shown in FIG. 2.

When the human player wishes to give the artificial expression to the acoustic piano tones, the human player depresses the pedal of the pedal mechanism 110, and makes the acoustic piano tone prolonged or lessened in loudness depending upon the depressed pedal.

Electric System

Figure 3:
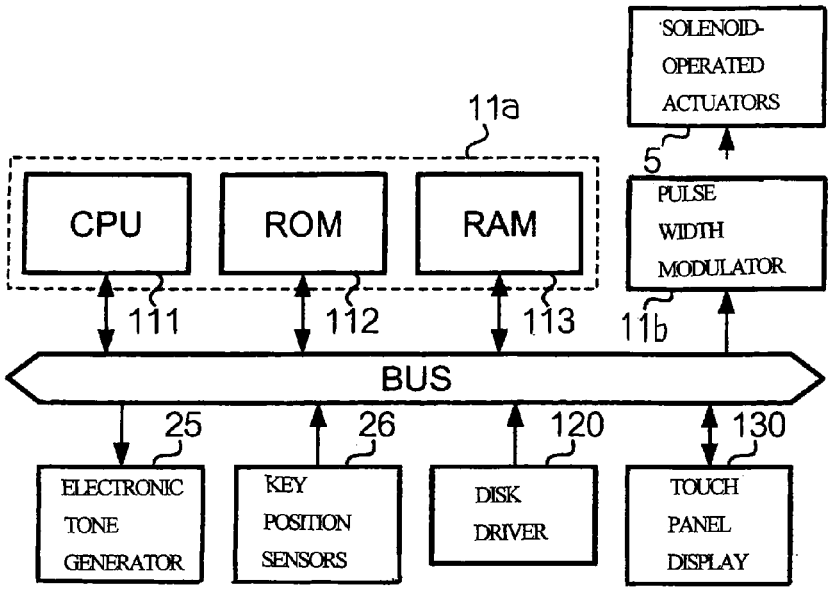
FIG. 3 is a block diagram showing the system configuration of an electric system of the automatic player piano.

Turning to FIG. 3, the electric system 20 includes an array of solenoid-operated key actuators 5, an information processing system 11*a*, pulse width modulators 11*b*, an electronic tone generator 25, an array of key position sensors 26, a disk driving unit 120 and a touch display panel 130. A central processing unit 111, which is abbreviated as "CPU", peripheral processors (not shown), a program memory 112, a working memory 113, a shared bus system (not shown), various interfaces (not shown) and other system components are incorporated in the information processing system 11*a*. Read only memory devices and random access memory devices respectively form parts of the program memory 112 and part of working memory 113. For this reason, abbreviations "ROM" and "RAM" stand for the program memory 112 and working memory 113 in FIG. 3. Electrically erasable and program memory devices and a hard disk driver may form other parts of the program memory 112. A flag, which is indicative of the partial automatic playing for the exhibition, is defined in the working memory, and is referred to as an "exhibition flag".

The information processing system 11*a*, pulse width modulators 11*b*, array of solenoid-operated key actuators 5 and array of key position sensors 26 form parts of the automatic playing system and also parts of the electronic assistant system. A difference between the electronic playing system and the electronic assistant system is software.

The information processing system 11*a* is the origin of the data processing capability. A computer program is stored in the program memory 112 together with control parameters, and is broken down into a main routine program and subroutine programs. While the main routine program is running on the central processing unit 111, human players can communicate with the information processing system 11*a*. The information processing system 11*a* produces visual images expressing a job menu, prompt messages etc. on the touch display panel 130, and the human players give their instructions to the information processing system 11*a* by touching an area or areas of touch display panel 130 where the visual image or images are produced. The information processing system 11*a* notifies the human player of current status of the electric system 20 through the touch display panel 130.

The pieces of performance data are accumulated through execution of one of the subroutine programs. The main routine program branches to the subroutine program through timer interruptions. Predetermined memory locations of working memory are assigned to all the black and white keys 1*b* and 1*c*. The key position signals S3 carry the pieces of performance data, which express the current key positions of the associated keys 1*b* and 1*c*, and are periodically sampled and converted to the digital key position signals S3' expressing the discrete values on the key position signals S3. The discrete values are stored in a data buffer associated with the analog-to-digital converters 121. When the central processing unit 111 enters the subroutine program, the central processing unit 111 fetches the pieces of performance data from the data buffer, and transfers them to the working memory. The pieces of performance data are stored in the memory locations assigned to the individual keys 1*b* and 1*c*. Thus, a predetermined number of values of each piece of performance data are accumulated in the working memory for the black keys 1*b* and white keys 1*c*.

The recording and playback are carried out through execution of the subroutine programs as follows. While a human player is playing a music tune on the acoustic piano 1, i.e., manual playing, the key position sensors 26 and pedal position sensors (not shown) monitor the keys 1*b*/1*c* and pedals of pedal mechanism 110, and notify the information processing system 11*a* of the movements of keys 1*b*/1*c* and movements of pedals through key position signals S3 representative of pieces of key position data and pedal position signals representative of pieces of pedal position data. The information processing system 11*a* analyzes the pieces of key position data and pieces of pedal position data, and produces a set of music data codes expressing tones to be produced and pedal effect to be imparted to the tones. The set of music data codes is stored in the hard disk in the hard disk driver 120. Otherwise, the music data codes are supplied to the electronic tone generator 25 so as to produce the electronic tones in real time fashion. Furthermore, a music tune is reproduced on the basis of the set of music data codes.

When the human player instructs the electric system 20 to perform a music tune without any fingering, i.e., through the automatic playing, the main routine program starts periodically to branch to the subroutine program for the automatic playing. A piano controller 12*a* and a servo controller 12*b* (see FIG. 2) express functions of controller 11 which are realized through the execution of subroutine program for the automatic playing. The piano controller 12*a* further participates in the recording on the acoustic piano 1. These functions are also used in the electronic assistance as will be hereinlater described. In other words, the functions are also realized through the execution of subroutine program for the electronic assistance. The servo controller 12*a* is assigned to the solenoid-operated key actuators 5 and solenoid-operated pedal actuators (not shown). The functions will be described in conjunction of the behavior of automatic player piano 100.

The array of solenoid-operated key actuators 5 are provided in association with the black keys 1*b* and white keys 1*c*, and are supported by the key bed 1*e* under the rear portions of black keys 1*b* and the rear portions of white keys 1*c*. Each of the solenoid-operated key actuators 5 has a solenoid 5*a* and a plunger 5*b*.

The solenoids 5*a* are connected in parallel to the pulse width modulators 11*b* so that the pulse width modulators 11*b* selectively supply driving signals S1 to the solenoids 5*a*. The plungers 5*b* are projectable from and retractable into the associated solenoids 5*a*, and the tips of plungers 5*b* are staying beneath the lower surfaces of keys 1*b* and 1*c* while the plungers 5*b* are retracted in the solenoids 5*a*.

While the driving signal S1 is following through the solenoid 5*a*, magnetic field is created around the plunger 5*b*, and the magnetic force makes the plunger 5*b* upwardly project from the solenoid 5*a*. As a result, the plunger 5*b* pushes the rear portion of the associated key 1*b* or 1*c*, and the black key 1*b* or white key 1*c* is moved without any fingering of a human player. The magnetic force is proportional to the mean current or duty ratio of the driving signal S1, and the information processing system 11*a* makes the pulse width modulator 11*b* vary the amount of mean current depending upon the loudness of tone to be produced.

When the driving signal S1 is removed from the solenoid 5*a*, the weight of key 1*b*/1*c*, action unit 3, hammer 2 and damper 6 presses the plunger 5*b* in the downward direction. As a result, the plunger 5*b* is retracted into the associated solenoid 5*a*.

Figure 4A:
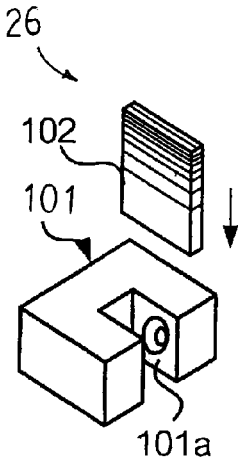
FIG. 4A is a schematic perspective view showing the structure of a key position sensor incorporated in the automatic player piano.
Figure 4B:
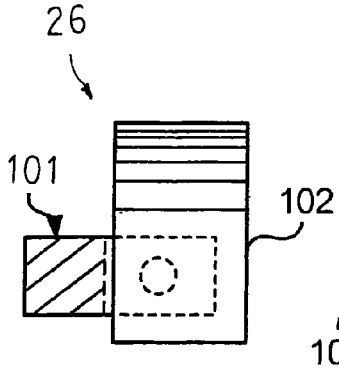
FIG. 4B is a side view showing relative position between an optical modulator and a photo-interrupter module.
Figure 4C:
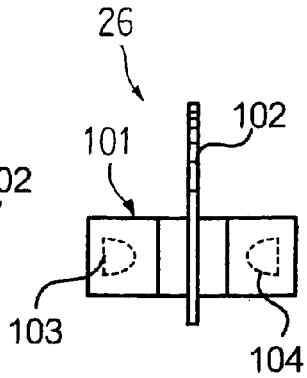
FIG. 4C is a front view showing sensor heads in the photo-interrupter module.

The array of key position sensors 26 is provided under the front portions of black keys 1*b* and the front portions of white keys 1*c*. The key sensors 26 are of the type converting the current key position to the amount of photo current. In detail, each of the key sensors 26 has a photo-interrupter module 101 and an optical modulator 102 as shown in FIGS. 4A to 4C. The photo-interrupter module 101 includes a bracket 101*a*, a pair of sensor heads 103 and 104, a light emitting diode (not shown) and a light detecting transistor (not shown). The light emitting diode and light detecting transistor are shared with other sensor heads (not shown).

The bracket 101*a* is formed with a gap, and the sensor heads 103 and 104 are opposed to each other across the gap, and the trajectory of optical modulator 102, which is fitted to the lower surface of associated key 1*b*/1*c*, passes through the gap. The sensor heads 103 and 104 are respectively connected to the light emitting diode and the light detecting element (not shown), and a light beam is created between the sensor heads 26*a* across the trajectory of optical modulator 102. The light beam form a light spot on the optical modulator 102, and the spot is relatively moved on the optical modulator depending upon a current position of optical modulator 102. The optical modulator 26*b* is secured to the associated key 1*b* or 1*c* in such a manner as downwardly to project from the lower surface of key 1*b* or 1*c* so that the spot is relatively moved together with the associated key 1*b*/1*c*. The transparency of optical modulator 102 is varied from the upper end to the lower end. While the associated black key 1*b* or white key 1*c* is traveling on the key trajectory, the light beam passes through the optical modulator 102, and the optical modulator 102 makes the amount of light passing therethrough varied depending on the current key position on the key trajectory. The light detecting element converts the incident light to photo current, and the photo current forms the key position signal S3. The key position signals S3 express the pieces of performance data, and are supplied from the key sensors 26 to the controller 11.

The pulse width modulator 11*b* is connected between the servo controller 12*b* and the solenoids 23*a*, and the driving signal S4 is selectively supplied from the pulse width modulator 11*b* to the solenoids 5*a*. The pulse width modulator 11*b* makes the driving signal S1 varied in mean current under the control of the servo controller 12*b*. The larger the amount of mean current is, the stronger the magnetic force is. The stronger the magnetic force is, the larger the plunger velocity and, accordingly, key velocity are. Thus, the movements of keys 1*b*/1*c* are controllable by means of the pulse width modulator 11*b*.

The key position sensors 26 are connected to the information processing system 11*a*, and notify the servo controller 12*b* of the current key positions through the key position signals S3. The pulse with modulators 1*b*, solenoid-operated key actuators 5, key position sensors 26 and servo controller

12*b* form in combination a servo control loop, and the movements of black keys 1*b* and white keys 1*c* are controlled through the servo control loop.

Figure 5:
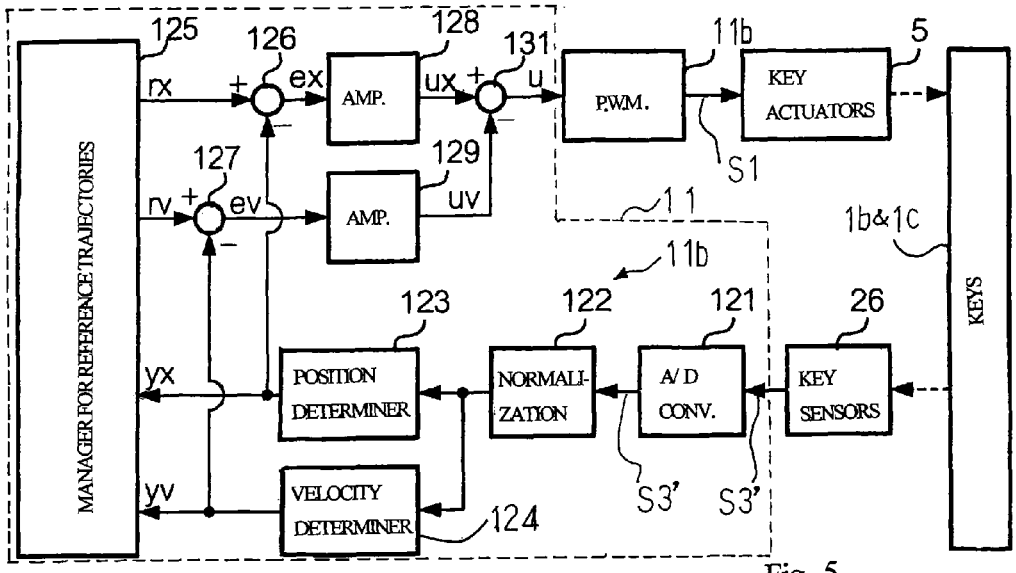
FIG. 5 is a block diagram showing a servo control loop realized in the automatic player piano.

FIG. 5 shows the servo control loop. As described hereinbefore, the servo control loop includes the pulse width modulators 11*b*, solenoid-operated key actuators 5 and the key position sensors 26, and the object is black keys 1*b* and white keys 1*c*. The solenoid-operated key actuators are respectively provided beneath the rear portions of keys 1*b*/1*c*, and the key position sensors 26 are respectively provided under the front portions of keys 1*b*/1*c*.

The servo control loop further includes analog-to-digital converters 121 for converting the analog key position signals S3 to digital key position signals S3', and the pieces of performance data are transferred from the analog key position signals S3 to the digital key position signals S3'. The pieces of performance data and pieces of reference key trajectory data are supplied from the analog-to-digital converters 121 and piano controller 12*a* to the servo controller 12*b*.

The pieces of reference key trajectory data express reference forward key trajectories and reference backward key trajectories, and the piano controller 12*a* produces the pieces of reference trajectory data on the basis of the music data codes for the black keys 1*b* and white keys 1*c* to be moved.

The reference forward key trajectory is a series of value of target key position varied with time. If the black key 1*b* or white key 1*c* travels on the reference forward key trajectory, the black key 1*b* or white key 1*c* passes a reference point at a target value of reference key velocity. The key velocity at the reference key point, i.e., reference key velocity is well proportional to the hammer velocity immediately before the collision with the string 4, and the hammer velocity immediately before the collision is well proportional to the loudness of tone. For this reason, it is possible to control the loudness of tones by using the reference forward key trajectory.

On the other hand, the reference backward key trajectory is a series of values of target key position toward the rest position. If the black key 1*b* or white key 1*c* travels on the reference backward key trajectory, the released key 1*b*/1*c* permits the damper unit 6 to be brought into contact with the vibrating string 4 at the time to make the note-off event occur, and the acoustic piano tone is decayed.

The servo controller 11*b* includes the following functions. Boxes 122, 123 and 124 stand for normalization, position determination and velocity determination. Individualities of the acoustic piano 1 are eliminated from the pieces of performance data during the normalization 122, and current key position yx and current key velocity yv are determined during the position determination 123 and velocity determination 124, respectively.

The servo controller 11*b* further includes functions of manager for reference trajectories 125, subtraction 126, 127, amplification 128, 129 and addition 131. A target key velocity rv is calculated from the series of values of target key position rx through the manager for reference trajectories 125, and the target key position rx and target key velocity rv are respectively compared with the current key position yx and current key velocity yv through the subtraction 126 and 127 so that position difference ex and velocity difference ev are determined. The position difference ex and velocity difference ev are amplified through the amplification 128 and 129, and the results ux and uv are added to each other through the addition 131. The sum u is indicative of a target amount of mean current, and is supplied to the pulse width modulator 11*b*. The driving signal S1 is adjusted to the target amount of mean current so as to minimize the position difference ex. Thus, the black keys 1*b* and white keys 1*c* are forced to travel on the reference forward key trajectories and reference backward key trajectories through the functions of servo controller 11*b*.

When the time to start the depressed key 1*b* or 1*c* comes, the piano controller 12*a* starts periodically to supply the values of target key position rx on the reference forward key trajectory to the servo controller 12*b*. The above-described functions are repeated, and the depressed key 1*b* or 1*c* is forced to travel on the reference forward key trajectory.

When the time to start the released key 1*b* or 1*c*, the piano controller 12*a* starts periodically to supply the values of target key position rx on the reference backward key trajectory to the servo controller 12*b*. The above-described functions are further repeated, and the released key 1*b* or 1*c* is forced to travel on the reference backward key trajectory.

As described hereinbefore, the black keys 1*b* and white keys 1*c* are controlled through the servo control loop for the electronic assistance. While the servo control loop is being activated for the partial automatic playing, the manager for reference trajectories 125 transfers the values of current key position yx and values of current key velocity yv to the piano controller 12*a*, and the piano controller 12*a* checks the values of current key position yx and values of current key velocity yv to see whether or not the key 1*b* or 1*c* takes a particular sort of key movements. If the answer is given negative, the piano controller 12*a* does not determine any reference trajectory for the exhibition, and prohibits the servo controller 12*b* from the servo control. As a result, the acoustic tones are simply produced through the manual playing.

If, on the other hand, the answer is given affirmative, the piano controller 12*a* determines a reference key trajectory for the particular sort of key movement, and the servo controller 12*b* repeats the above-described servo control sequence so as to give the exhibition to the human player. The reference key trajectory for the exhibition will be hereinlater described in more detail.

The electronic tone generator 25 includes a waveform memory, data read-out modules and a sound system, and a headphone is incorporated in the sound system together with amplifiers and loudspeakers. When a key event data code arrives at the electronic tone generator 25, the note number and loudness of tone to be produced are determined on the basis of the key event data code. When the waiting time period from the previous key event is expired, the data read-out module starts to read out pieces of waveform data expressing the waveform of an audio signal from the waveform memory. The pieces of waveform data are formed into the audio signal, and the audio signal is supplied through the amplifiers to the loudspeakers or headphone.

The touch panel display unit 130 is a combination of a liquid crystal display panel and a matrix switch overlapped with the monitor screen of the liquid crystal display panel. The touch panel display unit 130 is provided on the piano cabinet 1*d* on the left side of a music rack 1*f* so that a human player can give his or her instruction to the electric system 20 by pushing areas of the matrix switch over certain visual images produced on the monitor screen of the liquid crystal display panel without standing up. As described hereinbefore, the information processing system 11*a* produces visual images expressing the job menu, prompt messages, confirmation messages and current status of the electric system 20 on the touch panel display panel 130. Thus, the touch panel display unit 130 serves as a man-machine interface. While a human player is playing a music tune on the acoustic piano 1, the score is reproduced on the touch panel display unit 130, and is scrolled together with the progress of performance.

The key bed 1*e* is partially cut out so as to form a hollow space, and the controller 11 is inserted into the hollow space.

(See FIG. 1.) The housing of controller 11 has a front panel, which is coplanar with the front surface of the key bed 1*e*, and the disk driving unit 120 is exposed to the human player, who is sitting on a stool for fingering. For this reason, while a disk tray is staying at state projecting from the front panel of the housing of controller 11, the human player puts an information disk such as, for example, a CD (Compact Disc) or a DVD (Digital Versatile Disc) on the disk tray. Thereafter, the human player retracts the disk tray into the housing of controller 11. Sets of music data codes may be stored in the electrically erasable and programmable memory such as flash memories.

Plural sets of music data codes express music tunes, and are stored in the information disk. The computer program may be stored in another information disk. When the disk tray is retracted, the disk driving unit 120 gets ready to read out any one of the plural sets of music data codes from the information disk. When a user specifies a music tune, the disk driving unit 120 transfers the set of music data expressing the music tune from the information disk to the working memory. In this instance, the formats of music data codes are defined in the MIDI (Musical Instrument Digital Interface) protocols.

Behavior of Automatic Player Piano

The automatic player piano 100 has plural modes of operation such as a manual playing mode for the manual playing on the acoustic piano 1, a recording mode for performance on the acoustic piano 1, an automatic playing mode and an electronic assisting mode for the partial automatic playing. Both of the piano controller 12*a* and servo controller 12*b* stand idle in the manual playing mode, and only the piano controller 12*a* is active in the recording mode. Both of the piano controller 12*a* and servo controller 12*b* are active in the automatic playing mode, and the exhibition flag is pulled down. On the other hand, the exhibition flag is raised in the electronic assisting mode, and both of the piano controller 12*a* and servo controller 12*b* are active. These modes of operation form parts of the job menu, and the central processing unit 111 produces the job menu on the touch panel display unit 130 during the execution of main routine program. For this reason, users can select one of the modes of operation through the touch panel display unit 130.

Figure 6:
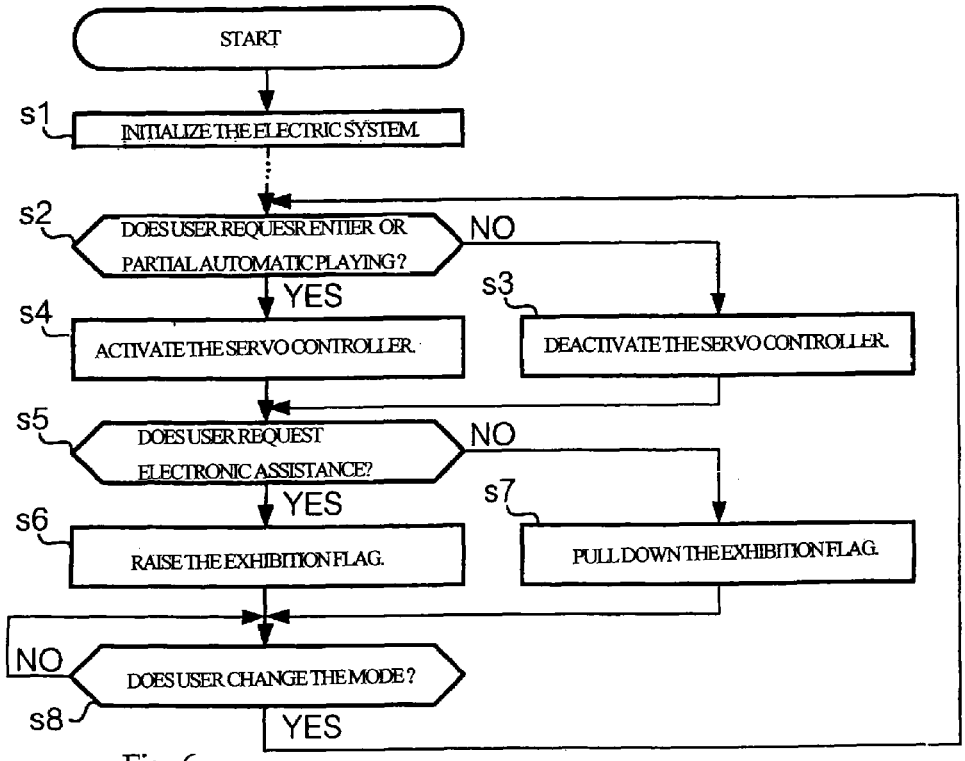
FIG. 6 is a flowchart showing a part of job sequence in a main routine of a computer program.

FIG. 6 shows a part of job sequence in the main routine program. When a user turns on the power switch of the electric system 20, the main routine program starts to run on the central processing unit 111. The central processing unit 111 initializes the electric system 20 as by step s1.

After producing the visual images of job menu on the touch display panel unit 130, the central processing unit 111 reiterates a loop having steps s2 to s8. In detail, the central processing unit 111 checks the memory location of working memory assigned user's instruction to see whether or not the user requests the automatic playing or partial automatic playing, i.e., entire or partial automatic playing as by step s2. If the user selects other modes of operation, the answer is given negative "NO", and the central processing unit 111 deactivates the servo controller 12*b* as by step s3.

If, on the other hand, the user selects the automatic playing mode or electronic assisting mode, the answer at step s2 is given affirmative "YES", and the central processing unit 111 activates the servo controller 12*b* for the automatic playing or partial automatic playing as by step s4.

Subsequently, the central processing unit 111 checks the working memory to see whether or not the user requests the electronic assistance as by step s5. If the user requests the electronic assistance, the answer at step s5 is given affirmative "YES", and the central processing unit 111 raises the exhibition flag as by step s6.

If, on the other hand, the user selects the automatic playing mode, the answer at step s5 is given negative "NO", and the central processing unit 111 pulls down the exhibition flag as by step s7.

After the execution of job at step s6 or s7, the central processing unit 111 checks the working memory to see whether or not the user changes the mode of operation as by step s8. If the answer is given negative "NO", the central processing unit repeats the job at step s8. On the other hand, when the user changes the mode of operation, the central processing unit 111 returns to step s2, and executes the jobs at step s2 to s7, again.

Figure 7:
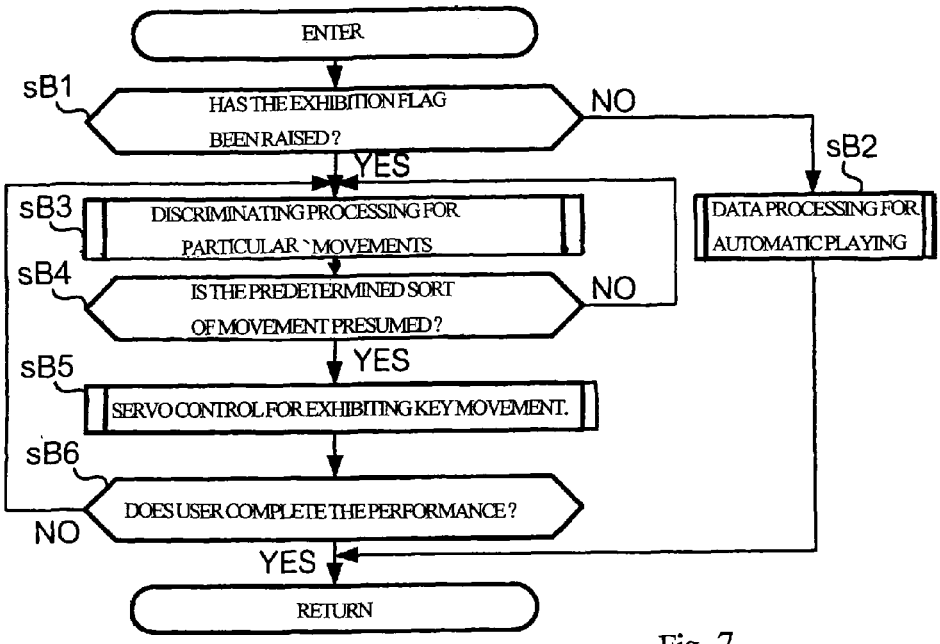
FIG. 7 is a flowchart showing a job sequence for a servo controller and a piano controller.

FIG. 7 shows a flowchart showing a job sequence for the piano controller 12*a* and servo controller 12*b*. When the user selects the automatic playing mode or electronic assisting mode, the piano controller 12*a* cooperates with the servo controller 12*b* as shown in FIG. 7.

First, the central processing unit 111 checks the working memory to see whether or not the exhibition flag has bee raised as by step sB1. If the user has instructed the automatic playing to the electric system 20, the exhibition flag is kept down, and the answer is given negative "NO". With the negative answer, the central processing unit 111 executes the jobs in the subroutine program for the automatic playing as by step sB2.

On the other hand, if the user has instructed the electronic assistance to the electric system 20, the exhibition flag is raised, and the answer is given affirmative "YES". With the positive answer, while the user is fingering a music tune on the acoustic piano 1, the central processing unit 111 executes the jobs in the subroutine program for electronic assistance.

In detail, while the user is fingering the music tune on the acoustic piano 1, the key position sensors 26 vary the magnitude of key position signals S3, and the central processing unit 111 periodically fetches the pieces of performance data represented by the key position signals S3, and accumulates the pieces of performance data in predetermined memory locations in the working memory.

The central processing unit 111 analyzes the pieces of performance data for the key movements as by step sB3, and checks the analysis results to see whether or not the pieces of performance data make the particular sorts of key movements presumed as by step sB4. When the user simply depresses and releases the black keys 1*b* and white keys 1*c*, any assistance is not required for the user, and the answer at step sB4 is given negative "NO". With the negative answer, the central processing unit 111 returns to step sB3, and reiterates the loop consisting of steps sB3 and sB4 during the performance on the acoustic piano 1.

If, on the other hand, the user performs a note or notes on the music score through one of the playing techniques such as, for example, repetition, the piano controller 12*a* and servo controller 12*b* are expected to give the exhibition for the playing technique, and the answer at step sB4 is given affirmative "YES". With the positive answer, the piano controller 12*a* determines the reference trajectory for an exhibiting key movement, and the servo controller 12*b* forces the black key 1*b* or white key 1*c* to travel on the reference key trajectory as by sB5. As a result, the user learns the playing technique through the tactile impression on his or her fingers.

The central processing unit 111 checks a memory location in the working memory to see whether or not the user instructs the electric system 20 to stop the electronic assistance, i.e., whether or not the user completes the performance as by step sB6. While the user is fingering the music tune on the acoustic piano 1, the electronic assistance is required for him or her, and the piece of instruction data is not found in the working memory. Then, the answer at step sB6 is given negative "NO", and the central processing unit 111 returns to step sB3.

When the user completes the performance, he or she gives the electric system 20 to stop the electronic assistance, and the answer at step sB6 is given affirmative "YES". With the positive answer, the central processing unit 111 returns to the main routine.

Figure 8:
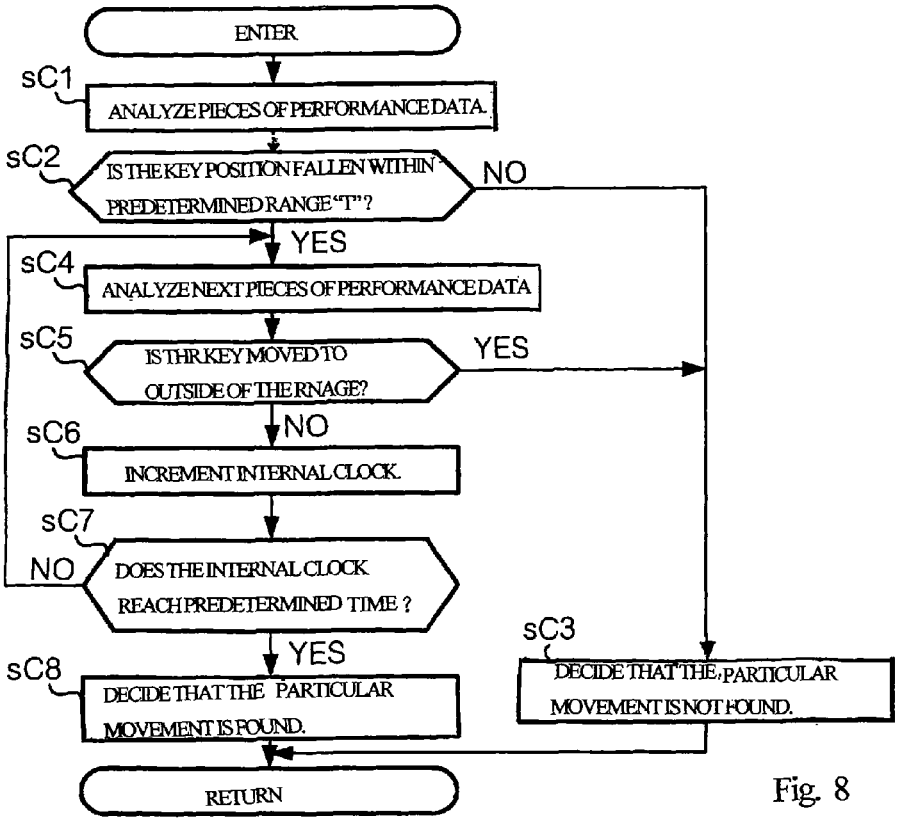
FIG. 8 is a flowchart showing a job sequence for finding particular playing techniques.

FIG. 8 shows how the piano controller 12*a* discriminates the particular playing techniques from the simply depressed-and-released playing technique. In this instance, the electronic assistant system gives rise to the partial automatic playing for the following particular playing techniques;

1) Repetition,

2) Tone generation at the weakest loudness in the acoustic piano 1, and

3) Forte-piano.

A player rapidly depresses and releases the black key 1*b* or white key 1*c*, and repeats the depressing and release in the repetition. A tone is repeatedly produced at a certain pitch within a short time period in the repetition.

The central processing unit 11 analyzes the pieces of performance data so as to find out moved keys 1*b* and 1*c* as by step sC1. All the black keys 1*b* and white keys 1*c* stay at the rest position before initiation of performance so that the central processing unit 111 does not find any moved key. In this situation, the central processing unit 111 does not proceed to the next step, and monitors the black keys 1*b* and white keys 1*c*.

Figure 9:
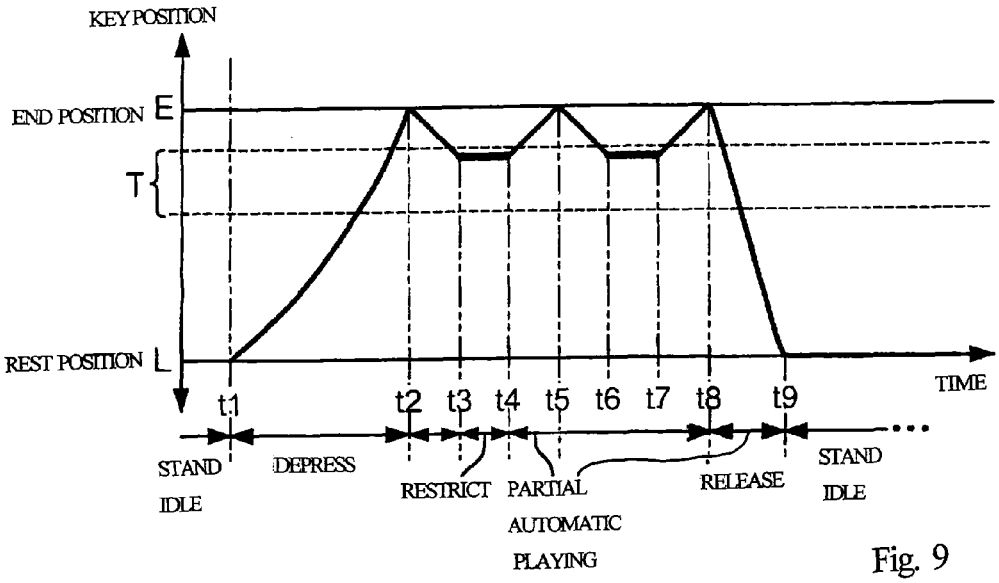
FIG. 9 is a diagram showing movements of a key in repetition.

A piece of performance data is assumed to indicate that the player gives rise to key movements indicative of repetition, i.e., one of the particular playing techniques. FIG. 9 shows the movements of key 1*b*/1*c* in the repetition. The key 1*b*/1*c* starts the rest position L at time t1. The key 1*b*/1*c* is downwardly moved toward the end position E through a keystroke range T, and reaches the end position E at time t2. The key 1*b*/1*c* returns to the keystroke range T at time t3, and is maintained in the stroke range T in a predetermined period, i.e., from time t3 to time t4. In this instance, there is the keystroke range T for the key movements in repetition, and the keystroke range T is from 6 millimeters to 8 millimeters from the rest position L. In this situation, the electric system 20 gives the player the electronic assistance through the partial automatic playing as follows.

The central processing unit 111 checks the piece of performance data to see whether or not the key 1*b*/1*c* is found in the keystroke range T as by step sC2. In case where the player takes the particular playing technique, the key 1*b*/1*c* stays in the keystroke range T for a certain time period. Therefore, if the key 1*b*/1*c* is found out of the keystroke range T, there is not any possibility to take the particular playing technique. The answer at step sC2 is given negative "NO", and the central processing unit 111 decides that the particular key movement, i.e., the particular playing technique is not found as by step sC3.

When the key 1*b* or 1*c* is found in the keystroke range T, there is a possibility that the player takes the particular playing technique, and the answer at step sC2 is given affirmative "YES". With the positive answer, the central processing unit 111 determines the current key position and current key velocity through the analysis on the piece of performance data as by step sC4, and determines whether or not the key 1*b* or 1*c* is moved to the outside of keystroke range T as by step sC5.

In case where the key 1*b* or 1*c* merely passes through the keystroke range T, the answer at step sC5 is given affirmative "YES", and the central processing unit 111 determines that the particular key movement is not found at step sC3.

On the other hand, when the player takes the particular playing technique, the key 1*b* or 1*c* is still found in the keystroke range T, and the answer at step sC5 is given negative "NO". With the negative answer, the central processing unit 111 starts the internal clock, and increments the time as by step sC6.

Subsequently, the central processing unit 111 checks the internal clock to see whether or not a predetermined time is read on the internal clock as by step sC7. If the answer at step sC7 is given negative "NO", the central processing unit 111 returns to step sC4, and reiterates the loop consisting of steps sC4 to sC7 until the answer is changed affirmative.

In case where the player keeps the key 1*b* or 1*b* in the keystroke range T from time t3 to time t4, the internal clock reaches the predetermined time, and the answer at step sC7 is changed to affirmative "YES". It is confirmed that the key 1*b* or 1*c* continuously found in the keystroke range T for the predetermined time. Then, the central processing unit 111 determines that the player starts to take the particular playing technique as by step sC8.

It is rare to keep the black keys 1*b* and white keys 1*c* in the keystroke range T for the predetermined time period in performance except for the particular playing techniques. For this reason, the piano player 12*a* can discriminate the particular playing techniques through the jobs at steps sC2, sC5 and sC7. In case where the player produces the tones in the repetition, the following key movements continuously take place:

1. The key 1*b* or 1*c* is moved from the rest position L to the end position E, (see from time t1 to time t2)
2. The key 1*b* or 1*c* starts to return toward the rest position immediately after reaching the end position E, (see at time t2) and
3. The key 1*b* or 1*c* stays in the keystroke range T for the predetermined time period. (See from time t3 to time t4)

As to the keystroke range T, if the player unintentionally makes the key 1*b* or 1*c* get closer to the rest position L than the keystroke range T, the associated damper unit 6 is brought into contact with the vibrating string 4, and the tone is decayed. In other words, the player is expected to keep the key 1*b* or 1*c* at an appropriate key position at which the associated damper unit 6 is not brought into contact with the string 4 during the repetition. From this point of view, the keystroke range T is determined in such manner that the damper units 6 are kept spaced from the associated string 4 in so far as the keys 1*b* and 1*c* stay in the keystroke range T. In case where the repetition shown in FIG. 9, the key 1*b* or 1*c* is floating 7 millimeters over the rest position.

The electronic assistant system decides that the player is producing the tones in repetition at time t4, and starts the partial automatic playing. In other words, when the piano controller 12*a* finds the particular key movements expressing the repetition, the piano controller 12*a* determines the reference forward key trajectory for the partial automatic playing, and the servo controller 12*b* starts to force the key 1*b* or 1*c* to travel on the reference forward key trajectory.

In case of repetition shown in FIG. 9, the servo controller 12*b* makes the plunger 5*b* upwardly project so that the key 1*b* or 1*c* is moved from the keystroke range T to the end position E. The key velocity toward the end position E is approximately equal to the key velocity in the key movement 1. The key 1*b* or 1*c* reaches the end position E at time t5, and the tone is generated through the acoustic piano 1.

Subsequently, the piano controller 12*a* produces a reference backward key trajectory from the end position E to a certain key position in the keystroke range T. The servo controller 12*b* makes the plunger 5*b* retracted, and permits the key 1*b* or 1*c* to return toward the rest position L. If the player exerts the finger force on the released key 1*b* or 1*c* for keeping the key 1*b* or 1*c* in the keystroke range T, the servo controller 12*b* does not make the solenoid-operated key actuator 5 force the key 1*b* or 1*c* to proceed over the keystroke range T. Even though the servo controller 12*b* forces the key 1*b* or 1*c* to travel on the reference key trajectory toward the rest position L, the difference between the target key position and current key position gets larger and larger due to the finger force on the key 1*b* or 1*c*. When the difference exceeds a threshold, the piano controller 12*a* admits that the player tries to keep the key 1*b* or 1*c* in the keystroke range T. (See FIG. 9, from time t6 to time t7) The piano controller 12*a* determines a reference forward key trajectory to the end position E after the expiry of predetermined time period between time t6 and time t7, and the servo controller 12*b* starts to force the key 1*b* or 1*c* to travel on the reference forward key trajectory at time t7. The key 1*b* or 1*c* reaches the end position E at time t8, and the tone is generated through the acoustic piano 1, again.

The key 1*b* or 1*c* starts to return toward the rest position L at time t8. The player does not wish to continue the repetition. For this reason, the player does not exert the finger force on the key 1*b* or 1*c* in the keystroke range T. The released key 1*b* or 1*c* passes through the keystroke range T, and reaches the rest position L at time t9.

Thus, the player is expected to keep the key 1*b* or 1*c* in the keystroke range T for the repetition by exerting the force on it. The player can learn the delicate key position for the repetition through the partial automatic playing. When the player wishes to terminate the repetition, he or she simply removes the finger force from the key 1*b* or 1*c*.

Moreover, even if a player is week in repetition, he or she can well perform music tunes with the assistance of electronic assistant system. Thus, the electronic assistant system of the present invention assists players in his or her concert as well as in music lessons.

Figure 10:
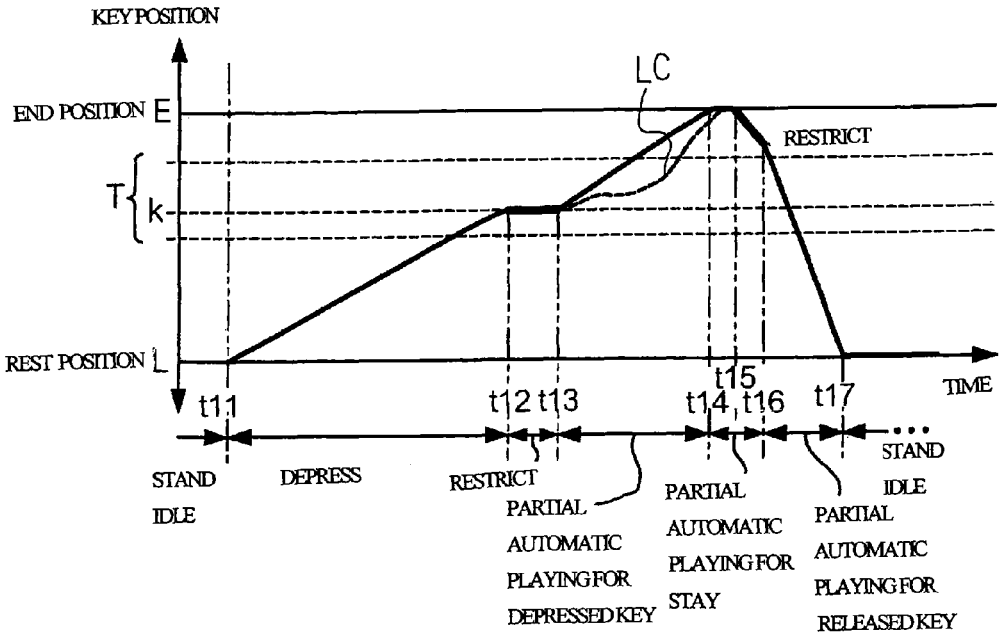
FIG. 10 is a diagram showing movements of a key for generating a tone at the smallest loudness.

Turning to FIG. 10 of drawings, description is made on the electronic assistance in the playing technique for generating a tone at the smallest loudness. The piano player 12*a* decides that the key 1*b* or 1*c* is softly depressed for generating a tone at the smallest loudness on the following conditions:

1. The key velocity is smaller than that in the simply depressed-and-released key, and
2. The key 1*b* or 1*c* is maintained in a keystroke range T for a predetermined time period.

The key 1*b* or 1*c* stays at the rest position L, and the player starts softly to depress the key 1*b* or 1*c* at time t11. The depressed key 1*b* or 1*c* reaches a key position k in the keystroke range at time t12. The player restricts the key 1*b* or 1*c* to the keystroke range T for the predetermined time period from time t12 to time t13. Thus, the key 1*b* or 1*c* satisfies the above-described conditions 1 and 2.

The electronic assistant system decides that the player is producing the tone at the smallest loudness at time t13, and starts the partial automatic playing at time. The piano controller 12*a* determines a reference forward key trajectory representative of a slowest key movement, and the servo controller 12*b* forces the key 12*b* or 12*c* to travel on the reference forward key trajectory. The solenoid-operated key actuator 5 exerts the magnetic force on the plunger 5*b*, and gives rise to the upward movement of key 1*b* or 1*c*. The key 1*b* or 1*c* reaches the end position E at time t14, and the tone is generated at the smallest loudness. The player learns how softly he or she is expected to depress the key with the assistance of the electronic assistant system.

Although players tend to depress the key along locus LC for the tones at smallest loudness, the electronic assistant system guides the player to the end position E at the constant velocity. In case where the keys 1*b* and 1*c* are moved on the loci LC, it is impossible always to control the keys 1*b* and 1*c* to be brought into contact with the strings 4 at the smallest key velocity. However, the reference forward key trajectory keeps the key velocity at the smallest value, and the player leans the key movement with the assistance of the electronic assistant system. As a result, the players can make the loci LC of keys 1*b* and 1*c* closer to the straight reference forward key trajectories.

In case where a player is week in tone generation the pianissimo, he or she can well perform music tunes in concert with the assistance of the electronic assistant system.

When the key 1*b* or 1*c* reaches the end position E, the piano controller 12*a* supplies a reference key trajectory for keeping the key 1*b* or 1*c* at the end position E, and the servo controller 12*b* keeps the key 1*b* or 1*c* at the end position E from time t14 to time t15.

The player gradually reduces the finger force on the depressed key 1*b* or 1*c*. The depressed key 1*b* or 1*c* slightly floats over the end position E. The distance from the end position E to the floating key 1*b* or 1*c* exceeds a threshold at time t16. Then, the piano controller 12*a* produces a reference backward key trajectory, and the servo controller 12*b* forces the released key 1*b* or 1*c* to travel on the reference backward key trajectory from time t16 to time t17.

Figure 11:
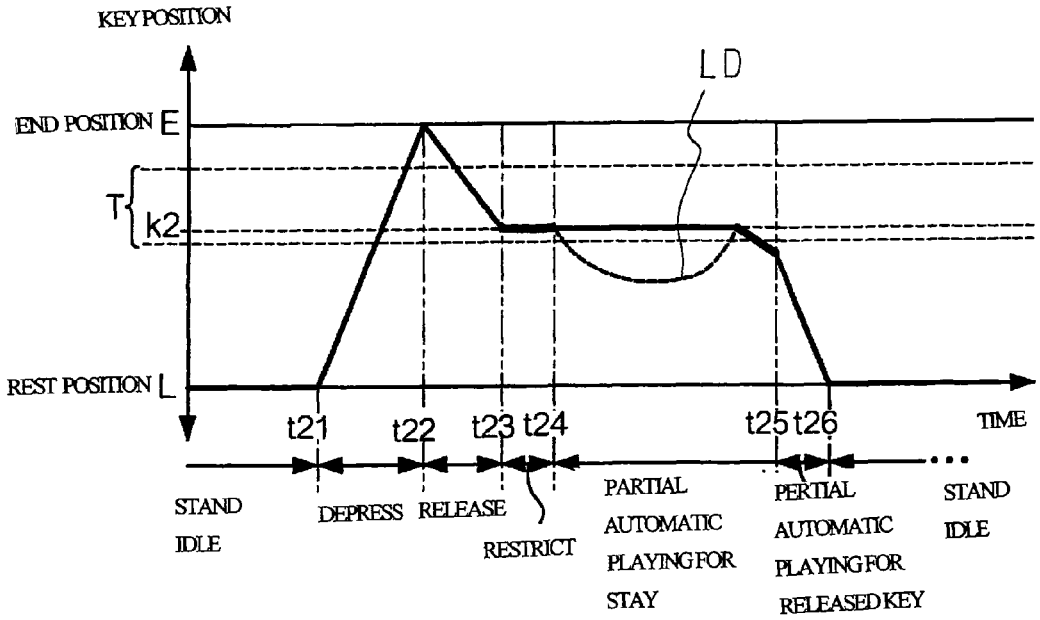
FIG. 11 is a diagram showing movements of a key for generating a tone in forte-piano.

FIG. 11 illustrates key movements for a tone in forte-piano. The forte-piano is featured as follows:

1. The black keys 1*b* and white keys 1*c* are moved from the rest position L to the end position E at key velocity larger than that in the simply depressed keys.
2. The black keys 1*b* and white keys 1*c* start to return to the rest position L immediately after arrival at the end position E.
3. The black keys 1*b* and white keys 1*c* are maintained in a keystroke range for a predetermined time period on the way to the rest position L.

FIG. 11 illustrates the key movements in the forte-piano. The key 1*b* or 1*c* starts the rest position L at time t21, and is moved toward the end position E at large key velocity. The key 1*b* or 1*c* reaches the end position E at time t22, and immediately starts to return toward the rest position L. The player stops the finger on the way to the rest position L at time t23, and keeps the key 1*b* or 1*c* around a key position k2 from time t23 to time t24. The key position k2 is 7 millimeters over the end position E, and is fallen within the keystroke range T. The internal timer (not shown) starts to measure the lapse of time at time t23. When the internal clock reaches time t24, the electronic assistant system decides that the player is producing the tone in forte-piano, and starts the partial automatic playing.

The piano controller 12*a* produces a reference key trajectory expressing the stay at the key position k2, and the servo controller 12*b* keeps the key 1*b* or 1*c* at the key position k2 from time t24. As a result, the tone is prolonged at small loudness. The player leans how to keep the key 1*b* or 1*c* around the key position k2 during the exhibition through the partial automatic playing for the stay at key position k2.

Even though players try to keep the keys 1*b* and 1*c* in stable at an intermediate key position, the keys 1*b* and 1*c* tend to move as indicated by a locus LD. If the player unintentionally makes the key 1*b* or 1*c* get closer to the rest position L as indicated by the locus LD, the associated damper unit 6 is brought into contact with the vibrating string 4, and the tone is decayed. In other words, the player is expected to keep the key 1*b* or 1*c* at an appropriate key position at which the associated damper unit 6 is not brought into contact with the string 4. From this point of view, the keystroke range T is determined in such manner that the damper units 6 are kept spaced from the associated string 4 in so far as the keys 1*b* stay in the keystroke range T.

While the servo controller 12*b* is keeping the key 1*b* or 1*c* at the key position k2, the piano controller 12*a* periodically checks the working memory to see whether or not the current key position is spaced from the target key position by a threshold value. When the player slightly moves the key 1*b* or 1*c* toward the rest position L, the difference between the current key position and the target key position exceeds the threshold value at time t25. Then, the piano controller 12*a* acknowledges that the player wishes to terminate the tone in forte-piano. The piano controller 12*a* produces a reference backward key trajectory, and the servo controller forces the key 1*b* or 1*c* to travel on the reference backward key trajectory from time t25 to time t26.

Thus, the player learns the forte-piano with the assistance of the electronic assistant system. If a player is week in forte-piano, he or she may wish to be assisted with the electronic assistant system in performance.

As will be appreciated from the foregoing description, the electronic assistant system of the present invention discriminates particular playing techniques from other playing techniques through the characteristic key movements in the early stages of particular playing techniques, and gives the exhibitions through the partial automatic playing immediately in the later stages. The player learns how to realize the particular playing techniques. Moreover, the player well performs the music passage with the assistance of the electronic assistant system.

Second Embodiment

Figure 12:
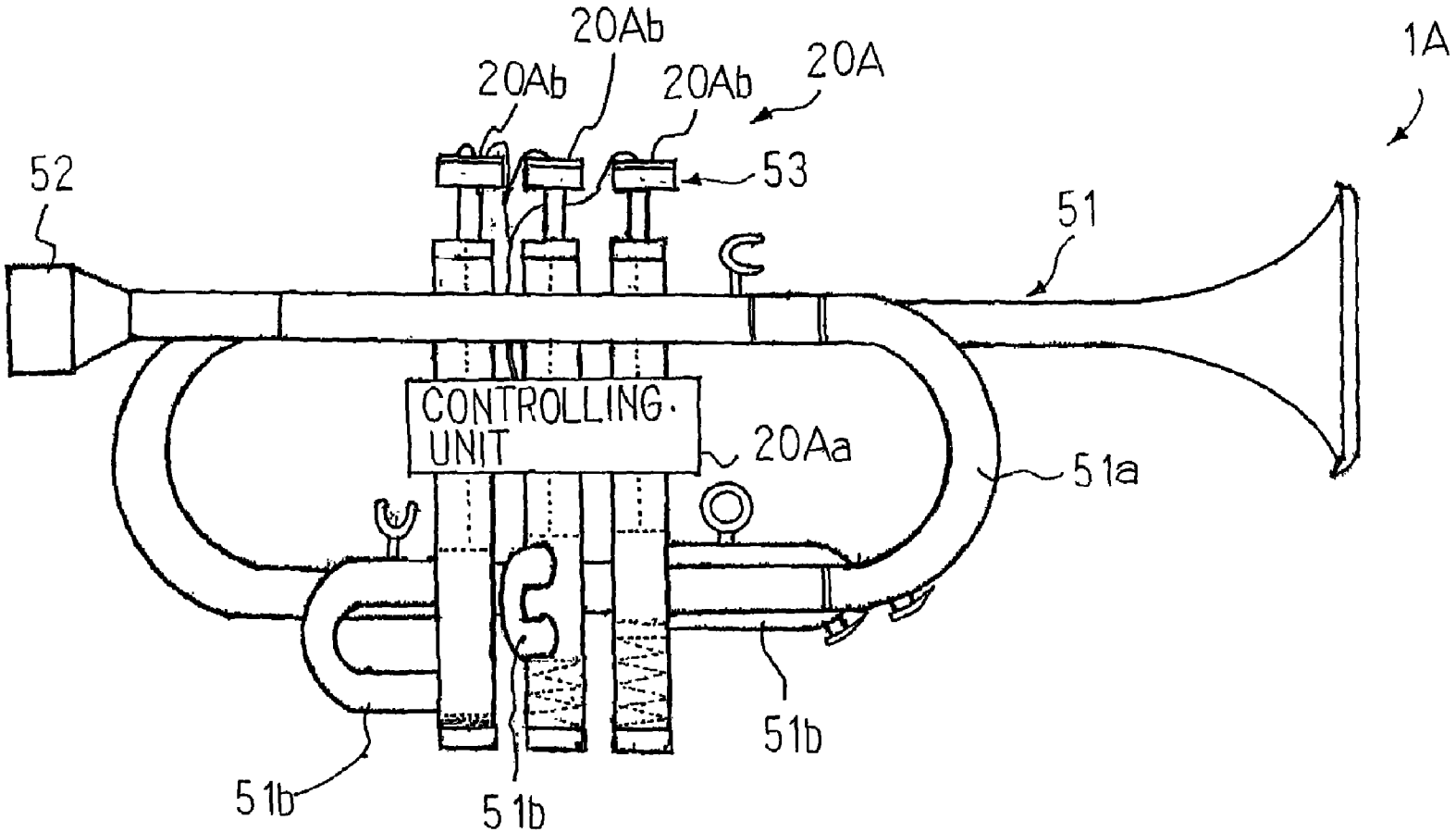
FIG. 12 is a side view showing a trumpet equipped with an electronic assistant system of the present invention.
Figure 13:
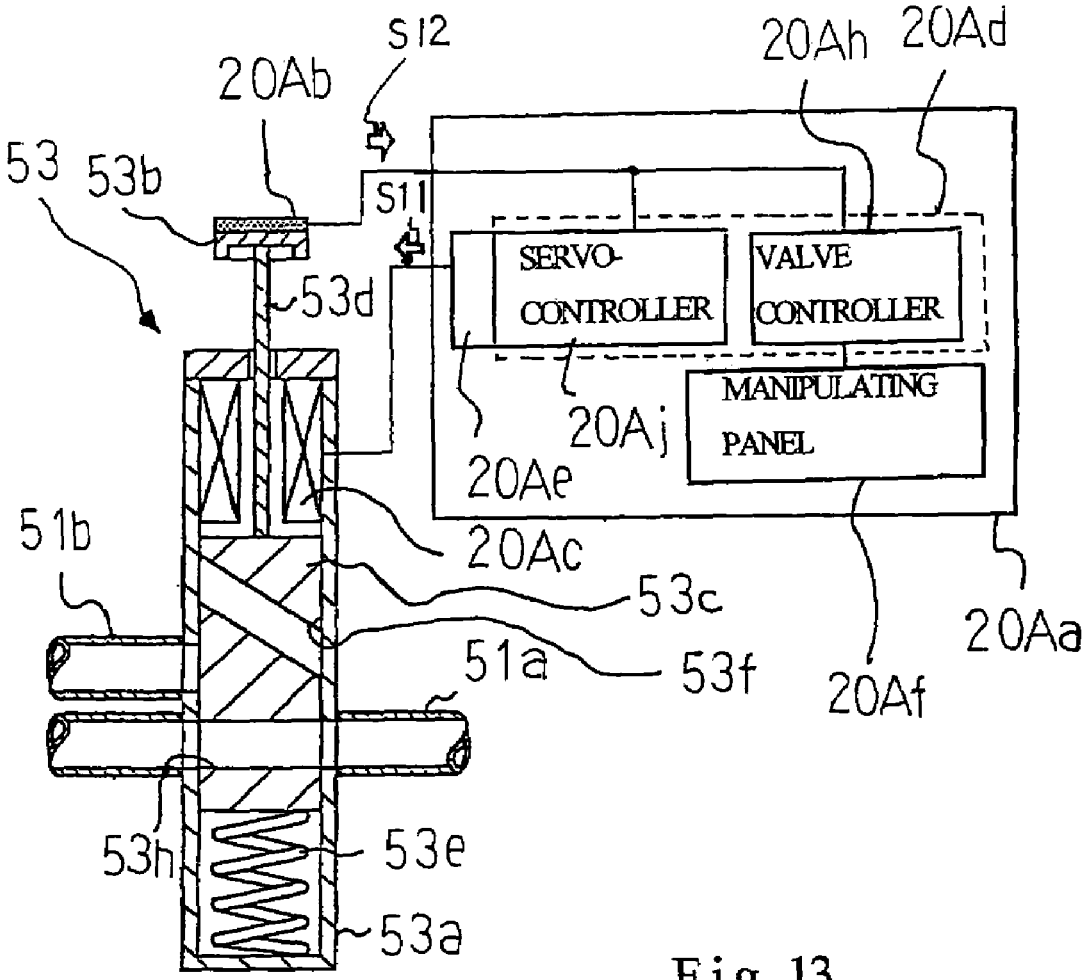
FIG. 13 is a cross sectional view showing a valve actuator and a controlling unit of the electronic assistant system.

Turning to FIGS. 12 and 13 of the drawings, an electronic assistant system 20A embodying the present invention is provided in association with a trumpet 1A. The trumpet 1A includes a tube body 51, a mouthpiece 52 and three piston valve assemblies 53. The tube body 51 has a long tube 51*a* and short tubes 51*b*, and a column of air is defined in the long tube 51*a*. The mouthpiece 52 is fitted to one end of the long tube 51*a*, and the piston value assemblies 53 are fitted to the tube body 51 so as to add additional air columns to the column of air defined in the long tube 51*a*.

Each of the piston valve assembly 53 has a cylinder 53*a*, a piston head 53*b*, a piston body 53*c*, a piston rod 53*d* and a return spring 53*e*, and air passages 53*f* and 53*h* are formed in the valve body 53*c*. The cylinder 53*a* is fitted to the tube body 51, and the piston rod 53*d* is connected between the piston head 53*b* and the valve body 53*c*. The valve body 53*c* is slidably inserted into the cylinder 53*c*, and the piston rod 53*d* projects from the cylinder 53*a*. The piston head 53*b* is connected to the piston rod 53*d*, and the return spring 53*e* is inserted between the bottom portion of cylinder 53*a* and the valve body 53*c*.

The return spring 53*e* always urges the valve body 53*c* in the upward direction. While any force is not being exerted on the piston head 53*b*, the air passage 53*h* is positioned in the inner space of the long tube 51*a*, and the other air passage 53*f* is closed at both ends thereof with the inner surface of the cylinder 53*a*. Any additional air column is not added to the column of air. The valve position, at which the air passage 53*h* is inserted into the inner space of long tube 51*a*, is hereinafter referred to as "rest position".

When a player exerts force on the piston head 53*b* in the downward direction, the valve body 53*c* is downwardly moved against the elastic force of the return spring 53*e*, and the air passage 53*f* interconnects the long body 51*a* and the short body 51*b*. The column of air is prolonged. The air passage 53*h* is closed at both ends thereof with the inner surface of cylinder 53*a*. The valve position, at which the air passage 53*f* interconnects the long tube 51*a* and the short tube 51*b*, is hereinafter referred to as an "end position".

While a player is buzzing on the mouthpiece 52, the column of air vibrates so as to produce tones. When the player changes the pitch of tones, he or she selectively manipulates the piston valve assemblies 53, and adds the additional air column to the vibrating column of air.

The electronic assistant system 20A includes a controlling unit 20Aa, pressure sensors 20Ab and solenoid-operated valve actuators 20Ac. The pressure sensors 20Ab are adhered to the piston heads 53*b*, respectively, and the solenoid-operated valve actuators 20Ac are respectively provided inside the cylinders 53*a* between the valve body 53*c* and the top portion of the cylinder 53*a*. While a driving signal S11 is flowing through the solenoid-operated valve actuator 20Ac, magnetic force is exerted on the piston rod 53*d*, and gives rise to downward movement of valve body 53*c*. The pressure sensors 20Ab convert pressure exerted thereon to a valve position signal S12. Since player's finger force is balanced with the resilient force of return spring 53*e*, value of pressure is varied in proportion to the stroke of piston, i.e., the current valve position. Thus, the valve position signal S12 is representative of the current valve body position.

The controlling unit 20Aa includes an information processing system 20Ad, pulse with modulators 20Ae and a manipulating panel 20Af. The information processing system 20Ad is similar to the information processing system 1*a* except for software, and realizes the functions "valve controller" 20Ah and "servo controller" 20Aj. The pulse width modulators 20Ae are same in function as the pulse width modulators 11*b*, and the touch display panel unit 130 is replaced with the manipulating panel 20Af. For this reason, no further description is made on the controlling unit 20Aa for the sake of simplicity.

When a player produces tones in tremolo, he or she pulls down the piston valve into a valve stroke range between the rest position and the end position, and keeps the piston value in the valve stroke range for a predetermined time period. Then, the valve controller 20Ad discriminates the playing technique for the tremolo, and produces a reference forward valve trajectory from the valve stroke range to the end position, a reference valve trajectory keeping the valve in the valve stroke range and a reference backward valve trajectory from the end position to the valve stroke range as similar to those shown in FIG. 9. The servo controller 20Ae forces the valve body 53*c* to travel on the reference forward valve trajectory, reference valve trajectory and reference backward valve trajectory so that the tones are rapidly changed between the two pitches.

As will be understood from the foregoing description, the player learns how to manipulate in tremolo with the assistance of the electronic assistant system 20A. Moreover, if the player is week in tremolo, he or she well performs the music passage with the assistance of electronic assistant system 20A.

Although particular embodiments of the present invention have been shown and described, it will be apparent to those skilled in the art that various changes and modifications may be made without departing from the spirit and scope of the present invention.

For example, the three sorts of playing techniques do not set any limit to the technical scope of the present invention. An electronic assistant system of the present invention may give a partial automatic playing for a silent note to players. The black keys 1*b* and white keys 1*c* are depressed at key velocity less than that for the tone at the smallest loudness. When the player depresses the black keys 1*b* and white keys 1*b* for the silent note, the depressed keys 1*b* and 1*c* make the damper units 6 spaced from the strings 4. However, the hammers 2 weakly escape from the action units 3, and do not reach the strings 4. As a result, any tone is not produced through the collision between the hammers 2 and the strings 4. The spaced damper units 6 make it possible to resonate with the vibrations of related strings 4. In order to realize the silent note, the piano controller 12*a* discriminates the slow key movement and the stay at the keystroke range T for a predetermined time period.

While the player is keeping the key 1*b* or 1*c* in the keystroke range T, the key 1*b* or 1*c* may be delicately moved around the key position such as k or k2.

The electronic assistant system may depress the key 1*b* or 1*c* at key velocity different from the key velocity in the key movement from the rest position L to the end position E. It is said that human players feel the repetition at 15 Hz difficult. However, a player can produce the tones in the repetition at 15 Hz or more than 15 Hz with the assistance of the electronic assistant system.

The tones may be repeated a predetermined number of times such as, for example, twice regardless of the finger force on the key 1*b* or 1*c*.

The partial automatic playing may be carried out in performance in staccato, and stand idle in legato. In this instance, the piano controller measures the time period at the end position E, and determines how to assist the player.

The partial automatic playing for released key may not be carried out in a modification of the first embodiment. In this instance, the piano controller 12*a* decays the driving signal S1 to the mean current of zero, and permits the released key 1*b* or 1*c* to return to the rest position L as similar to those of a standard acoustic piano.

The automatic player musical instrument does not set any limit to the technical scope of the present invention. The electronic assistant system may be installed in an acoustic piano, a harpsichord, an organ or an electronic keyboard without any automatic playing system. A muting system may be further installed in these sorts of keyboard musical instruments.

An electronic assistant system of the present invention may be provided in association with pedals of the keyboard musical instrument. Players exactly learn the pedaling with the assistance of the electronic assistant system.

The key position sensors 26 do not set any limit to the technical scope of the present invention. In another modification, two sorts of sensors such as, for example, position sensor and a velocity sensor may be incorporated in the electric system. In this instance, the key position and key velocity are directly converted to signals. Of course, an acceleration sensor is available for the electric system.

The electronic assistant systems may terminate the partial automatic playing at expiry of a predetermined time period. In this instance, even if the player continuously exerts the force on the key 1*b* or 1*c*, the electronic assistant system does not give the exhibition after the expiry of predetermined time period.

Although the particular playing techniques are discriminated through the detection of stoppage in the keystroke region or valve stroke region, certain playing techniques may be discriminated through a short backward key movement or a short backward valve movement. Otherwise, the player may inform the electronic assistant system of the entry into the particular playing technique by depressing the adjacent key or adjacent piston valve. Thus, the stoppage in the keystroke region and valve stroke region does not set any limit to the technical scope of the present invention. The piano controller 12*a* and valve controller 20Ah may give different exhibition to the player depending upon the keystroke or valve stroke at which the player stops the key or valve. In this instance, plural keystroke ranges may be defined on the key trajectories such as from 3 mm to 5 mm and from 5 mm to 7 mm. It is important to give the notice of entry into the particular playing technique in the early stage of the particular key movements. However, how to give the notice is not essential feature of the present invention.

The computer program of present invention may be offered to users as a computer program stored in a piece of magnetic tape, a magnetic disk, a flexible disk, an optical disk and an opto-magneto information storage medium. Otherwise, the computer program may be downloaded from a server computer through a communication network such as, for example, the internet.

The electronic assistant systems of the first and second embodiments may be prepared separately from the musical instruments 1 and 1A. In this instance, users buy the electronic assistant systems in the market, and combine the electronic assistant systems with the musical instruments.

The component parts and jobs carried out by information processing system are correlated with claim languages as follows. The key position sensors 26 as a whole constitute a "sensor system", and the pressure sensors 20Ab form in combination the "sensor system". The black keys 1*b* and white keys 1*c* are corresponding to "manipulators", and the piston valve assemblies 53 are also corresponding to the "manipulators". The solenoid-operated key actuators 5 are corresponding to "actuators", and the solenoid-operated valve actuators 20Ac are also corresponding to the "actuators".

The information processing system 11*a* and jobs at step sB3, i.e., steps sC1 to sC8 are equivalent to an "analyzer". The information processing system 20Aa also forms a part of the "analyzer". The functions 12*a* and 12*b* of information processing system 11*a*, i.e., the piano controller 12*a* and servo controller 12*b* realize a "driver", and the functions 20Ah and 20Aj of information processing system 20Ad also realize the "driver". The stay in the keystroke range T for the predetermined time period is indicative of "player's intention to produce music sound through a particular playing technique".

The key positions k and k2 are examples of an "intermediate position". The piano controller 12*a* serves as a "reference trajectory producer", and the valve controller 20Ah also serves as the "reference trajectory producer". The pulse width modulator 11*b*/20Ae serves as a "signal driver". The target key position rx and target key velocity rv are indicative of "target status", and the current key position yx and current key velocity rv are indicative of "actual status". The position and velocity are corresponding to "first sort of physical quantity" and "second sort of physical quantity".

The analog-to-digital converter 121, normalizer 122, position determiner 123 and velocity determiner 124 as a whole constitute an "actual status determiner", and the subtractors 126 and 127, amplifiers 128 and 129 and adder 131 form in combination a "deviation determiner".

The hammers 2, action units 3, strings 4 and damper units 6 as a whole constitute a "tone generator", and the tube body 51 and mouthpiece 52 as a whole constitute the "tone generator".

What is claimed is:

1. An electronic assistant system for a player, comprising:

a sensor system monitoring manipulators of a musical instrument, and producing detecting signals representative of pieces of performance data expressing movements of said manipulators;

actuators provided in association with said manipulators, and responsive to a driving signal so as to move said manipulators;

an analyzer connected to said sensor system, and analyzing said pieces of performance data to see whether or not at least one of said manipulators takes a particular movement indicative of player's intention to produce music sound through a particular playing technique during fingering of a human player on said manipulators; and a driver connected to said actuators and said analyzer, and supplying said driving signal to associated one of said actuators so as to give rise to a movement of said one of said manipulators featuring said particular playing technique in said fingering when said analyzer gives the answer affirmative for assisting said human player in learning said particular playing technique, wherein said analyzer searches said pieces of performance data for a piece of performance data expressing a stoppage for a certain time period between a rest position of the manipulator and an end position of said manipulator.

2. The electronic assistant system as set forth in claim 1, in which said piece of performance data expresses said stoppage at an intermediate position on the way from said end position to said rest position after arrival at said end position.

3. The electronic assistant system as set forth in claim 2, in which said driver gives rise to said movement repeated between said intermediate position and said end position so as to produce said music sound in repetition upon expiry of said certain time period.

4. The electronic assistant system as set forth in claim 2, in which said drivers gives rise to said movement in which said one of said manipulators is maintained around said intermediate position so as to produce said music sound in fortepiano.

5. The electronic assistant system as set forth in claim 1, in which said piece of performance data expresses said stoppage at an intermediate position on the way from said rest position to said end position.

6. The electronic assistant system as set forth in claim 5, in which said driver gives rise to said movement in which said one of said manipulators travels from said intermediate position to said end position at a minimum key velocity for producing said music sound.

7. The electronic assistant system as set forth in claim 1, in which said driver includes a reference trajectory producer producing at least one reference trajectory for said movement when the affirmative answer is received from said analyzer, a signal driver adjusting said driving signal to a target amount of mean current, and a servo controller connected to said reference trajectory producer and said signal driver and comparing target status on said reference trajectory with actual status of said one of said manipulator on an actual trajectory so as to determine said target amount of mean current depending upon difference between said target status and said actual status.

8. The electronic assistant system as set forth in claim 7, in which said servo controller includes a manager for reference trajectories determining a first sort of target physical quantity and a second sort of target physical quantity both varied with time on said reference trajectory and expressing said target status, an actual status determiner supplied with said detecting signal and determining the first sort of actual physical quantity and the second sort of actual physical quantity both expressing said actual status on the basis of said pieces of performance data, and a deviation determiner connected to said manager and said actual status determiner and determining difference between said first sort of target physical quantity and said first sort of actual physical quantity and difference between said second sort of target physical quantity and said second sort of actual physical quantity so as to determine said target amount of mean current.

9. A musical instrument on which a player performs pieces of music, comprising:

manipulators manipulated by said player for said pieces of music;

a tone generator connected to said manipulators, and responsive to the manipulation on said manipulators so as to produce music sound for said pieces of music;

an electronic assistant system provided in association with said manipulators, and including a sensor system monitoring said manipulators and producing detecting signals representative of pieces of performance data expressing movements of said manipulators, actuators provided in association with said manipulators and responsive to a driving signal so as to move said manipulators, an analyzer connected to said sensor system and analyzing said pieces of performance data to see whether or not at least one of said manipulators takes a particular movement indicative of player's intention to produce the music sound through a particular playing technique during fingering of a human player on said manipulators and a driver connected to said actuators and said analyzer and supplying said driving signal to associated one of said actuators so as to give rise to a movement of said one of said manipulators featuring said particular playing technique in said fingering when said analyzer gives the answer affirmative for assisting said human player in learning said particular playing technique, wherein said analyzer searches said pieces of performance data for a piece of performance data expressing a stoppage for a certain time period at an intermediate position between a rest position of the manipulator and an end position of said manipulator.

10. The musical instrument as set forth in claim 9, in which said manipulators and said tone generator form parts of a keyboard musical instrument.

11. The musical instrument as set forth in claim 10, in which said keyboard musical instrument has action units connected to said manipulators, hammers driven for rotation by said action units, strings struck with said hammers at the end of said rotation and dampers spaced from and brought into contact with said strings, and said action units, said hammers, said strings and said dampers form in combination said tone generator.

12. The musical instrument as set forth in claim 9, further comprising an automatic playing system selectively moving said manipulators for performing pieces of music without any fingering of a human player.

13. The musical instrument as set forth in claim 12, in which an information processing system is shared between said electronic assistant system and said automatic playing system.

14. The musical instrument as set forth in claim 9, in which said tone generator includes a tube body defining a vibratory column of air, and said manipulators are formed by valve assemblies for changing the length of said vibratory column of air.

15. The musical instrument as set forth in claim 9, in which said driver gives rise to said movement repeated between said intermediate position and said end position so as to produce said music sound in repetition upon expiry of said certain time period.

16. The musical instrument as set forth in claim 9, in which said driver gives rise to said movement in which said one of said manipulators is maintained around said intermediate position so as to produce said music sound in forte-piano.

17. The musical instrument as set forth in claim 9, in which said driver gives rise to said movement in which said one of said manipulators travels from said intermediate position to said end position at a minimum key velocity for producing said music sound.

18. The musical instrument as set forth in claim 9, in which said driver includes a reference trajectory producer producing at least one reference trajectory for said movement when the affirmative answer is received from said analyzer, a signal driver adjusting said driving signal to a target amount of mean current, and a servo controller connected to said reference trajectory producer and said signal driver and comparing target status on said reference trajectory with actual status of said one of said manipulator on an actual trajectory so as to determine said target amount of mean current depending upon difference between said target status and said actual status.

* * * * *